United States Patent [19]

Mizelle

[11] Patent Number: 4,703,527

[45] **Date of Patent: * Nov. 3, 1987**

[54] BEDDING SPRINGS AND BEDDING UNITS

[76] Inventor: Ned W. Mizelle, P.O. Box 5985, High Point, N.C. 27262

[ * ] Notice: The portion of the term of this patent subsequent to Dec. 24, 2002 has been disclaimed.

[21] Appl. No.: 813,089

[22] Filed: Dec. 24, 1985

Related U.S. Application Data

[63] Continuation-in-part of Ser. No. 532,137, Sep. 14, 1983, Pat. No. 4,559,654, and a continuation-in-part of Ser. No. 721,728, Apr. 10, 1985.

[51] Int. Cl.[4] ..... A47C 23/02

[52] U.S. Cl. ..... 5/247; 5/255; 5/253; 5/261

[58] Field of Search ..... 5/247, 253, 255, 260–262, 5/267, 272; 267/105, 107–109

[56] References Cited

U.S. PATENT DOCUMENTS

| | | | |
|---|---|---|---|
| 3,825,960 | 6/1974 | Inman et al. | 5/247 |
| 4,101,993 | 7/1978 | Yates et al. | 5/267 |
| 4,238,811 | 12/1980 | Mizelle | 5/247 |
| 4,339,834 | 7/1982 | Mizelle | 5/247 |
| 4,452,438 | 6/1984 | Hancock et al. | 5/255 |
| 4,559,654 | 12/1985 | Mizelle | 5/247 |

*Primary Examiner*—Gary L. Smith
*Assistant Examiner*—Michael F. Trettel
*Attorney, Agent, or Firm*—Beveridge, DeGrandi & Weilacher

[57] ABSTRACT

A bedding unit such as a box spring has springs with lower portions mounted on the frame of the unit, upper portions connected to the wire grid of the unit, and midportions which are collapsible to support the grid resiliently on the frame. The upper portion of a corner spring includes a vertically uncompressible loop which contacts the frame when the midportion is collapsed, thereby limiting the deflection of the spring. The loop also prevents the filler material fo the unit from collapsing inwardly. The main springs of the unit have upper portions which have hooks for engaging the grid wires of the unit. These hooks are located at opposite ends of the wire which forms the spring. The upper portions have transverse bars which are connected to the hooks by connecting sections.

21 Claims, 6 Drawing Figures

BEDDING SPRINGS AND BEDDING UNITS

REFERENCE TO RELATED APPLICATIONS

This is a continuation in part of U.S. patent application Ser. No. 532,137 filed Sept. 14, 1983, for bedding units and components for such units. This is also a continuation in part of U.S. patent application Ser. No. 721,728 filed Apr. 10, 1985, for bedding units and springs therefor. The earlier of these prior applications is issuing as U.S. Pat. No. 4,559,654 on Dec. 24, 1985. The subject matter of both of these earlier applications is incorporated herein by reference.

BACKGROUND OF THE INVENTION

This invention relates to improved springs and bedding units wherein nonspiral formed wire springs are used to support a wire grid on a frame.

In one respect, the invention disclosed in this specification pertains to an improved spring and unit wherein the spring has a uniquely formed upper portion provided with two hook means which engage a wire of the grid. This particular configuration expedites the manufacture of a bedding unit by facilitating the attachment of the springs to the wire grid and, if desired, it also makes it possible to eliminate the clips which are normally used for attaching the spring to the grid wires.

In another respect, the invention relates to a corner spring which, in addition to having desirable flexural characteristics, is constructed so as to limit the extent of downward movement of the corners of the wire grid while also preventing the inward collapsing action of any box spring filler material located between the corner spring and the ticking of the unit.

In another respect, the invention relates to an improvement wherein the bedding unit has springs with a desirable force distribution resulting from the mounting of the lower foot of the springs so that it may rotate during vertical collapsing movement of the spring's mid-portion.

SUMMARY OF THE INVENTION

In one respect, this invention relates to a bedding unit and a spring for such a unit wherein the spring has a lower portion connectible to the frame of the unit, an upper portion connected to the wire grid of the unit, and a midportion which connects the lower portion to the upper portion. The midportion is vertically collapsible to support the upper portion resiliently on the lower portion. The upper portion is substantially horizontal and it includes a pair of transverse bars and a pair of hook means, the latter being formed in opposite ends of the single resilient wire of the spring. Each hook means is arranged to extend over and hook under a wire of the wire grid. Preferably, the spring is of the limited deflection type wherein deflection is limited when the upper portion or grid contacts a torsion bar in the midportion of the spring. Connecting sections which connect the hook means to the transverse bars are preferably L-shaped and each of these includes a longitudinal bar which is positionable in underlying relation to a wire of the grid. These connecting sections preferably include a longitudinally oriented center bar portion which will lie parallel to and bear laterally against a grid wire engaged by the hook means. The frame preferably includes a plurality of parallel cross rails which extend from side-to-side of the unit, and the wire grid is preferably formed of a plurality of longwires which are in vertical alignment with the crossrails of the frame.

The invention also pertains to a corner spring and a bedding unit which utilizes such a corner spring. The corner spring is formed of a single resilient wire and it has a lower portion connectible to the frame, an upper portion connectible to the wire grid, and a midportion which connects the lower portion to the upper portion. The midportion is vertically collapsible to support the upper portion resiliently on the lower portion. The important and characteristic feature of the corner spring is that the upper portion has a vertical loop which is substantially uncompressible in a vertical direction.

Preferably, the upper portion of the corner spring comprises horizontal attachment bars which are clipped to the grid. These horizontal bars are angularly disposed relative to each other, and the vertical loop of the corner spring has opposite ends which extend to the horizontal attachment bars. The collapsibility of the midportion and the height of the vertical loop are such that the lower end of the vertical loop is downwardly movable to a position where it lies in the same horizontal plane as the lower portion of the spring. In this disposition, the vertical loop will contact the frame to limit the deflection of the corner spring. In the disclosed and preferred embodiment, the upper portion of the corner spring has four vertical bars, two of which form opposite legs of the vertical loop.

In another respect, the invention pertains to a spring in which there is a midportion which is resiliently collapsible and comprised of two vertically collapsible portions which are connected to opposite ends of the upper attachment portion of the spring. Each vertically collapsible portion has a torsion bar and connector bars. The important and characterizing feature of this aspect of the invention is that the lower portions of the spring are bars which are mounted on the frame and are rotatable in response to vertical collapsing movement of the midportion of the spring. This arrangement reduces the risk that the staples which attach the spring to the frame will pull out when the unit is subjected to severe usage.

Other significant features of the invention are recited in the following claims and will be understood more fully after a study of the following description and drawings.

DETAILED DESCRIPTION

Figure 1:
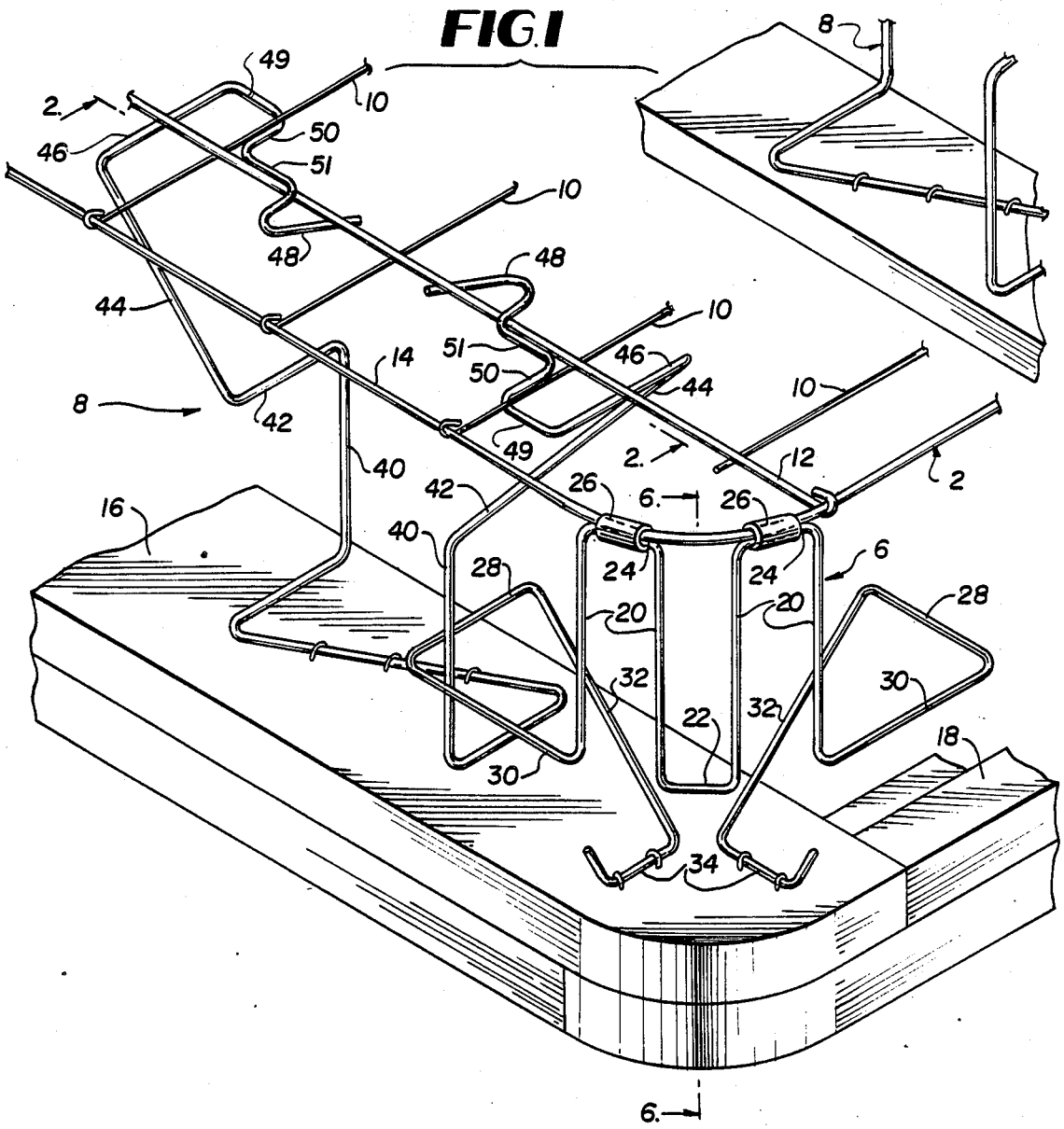
FIG. 1 is a perspective view showing a hook-topped spring and a corner spring mounted on a bedding unit which has a frame and a wire grid.
Figure 2:
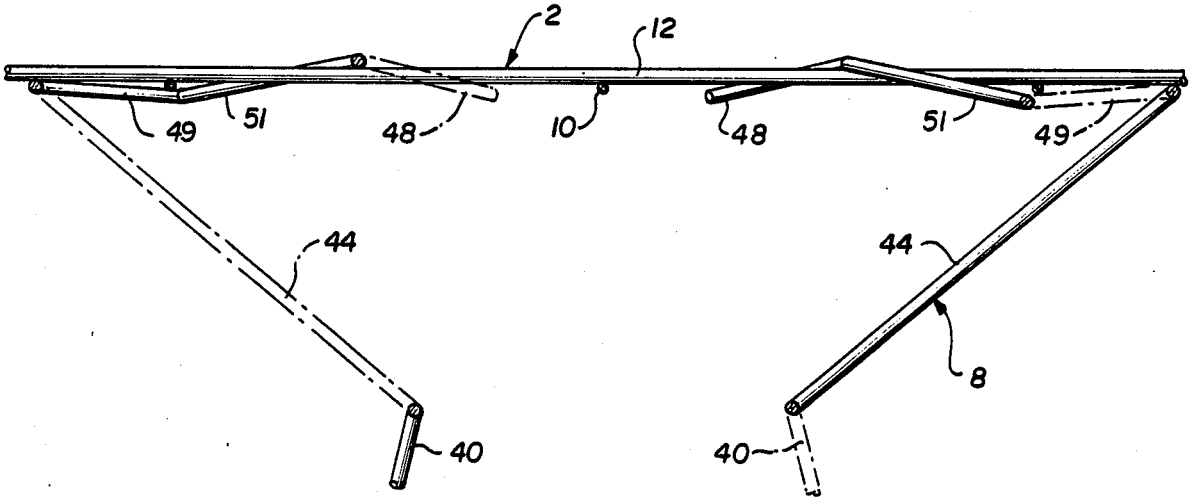
FIG. 2 is an elevational view of the hook-topped spring portion which is attached to the wire grid.

FIG. 1 shows a portion of a bedding unit, more specifically of the box spring type, wherein a wire grid 2 is supported on a frame 4 by a corner spring 6 and a main support spring 8.

The wire grid 2 is of conventional construction, being formed of a plurality of longwires 10 welded to a plurality of cross wires 12 at their intersections. The ends of the wires 10 and 12 are bent around and connected to a rectangular border wire 14 in a manner which is well known in the art. Different grid constructions may be used as, for example, a grid may have cross wires formed of spring steel, and these may either be clipped to the existing cross wires or bent at their ends and clipped to the border wire.

The frame 4 is also of conventional construction. It has a plurality of cross rails, preferably vertically aligned with the cross wires 12 of the grid. In FIG. 1, the frame components include the end rail 16 and a side rail 18. In the particular embodiment shown, the springs 6 and 8 are fastened by staples to the end rail 16.

Figure 5:
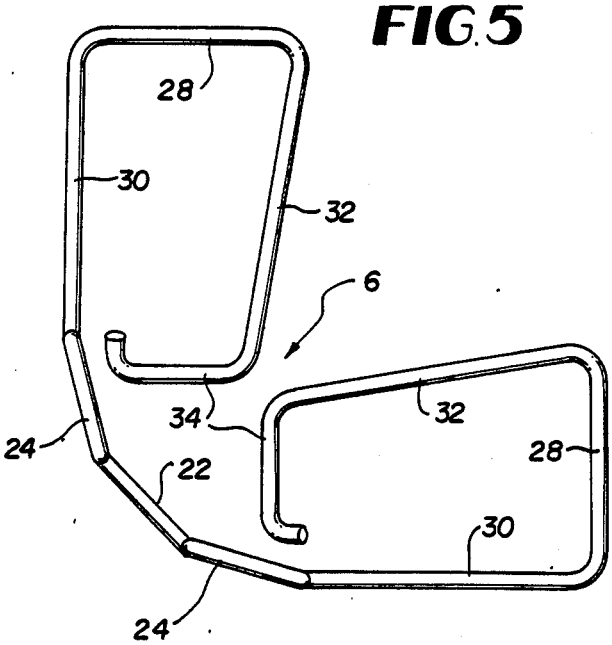
FIG. 5 is a plan view of a corner spring constructed according to the invention.

The upper portion of the corner spring 6 includes four vertical bars 20, the center two of which are connected at their lower ends by a horizontal bar 22 to form a vertically uncompressible loop. This loop is referred to as a vertical loop because it lies in a vertical plane. Preferably, but not essentially, there are vertical bars in this loop. The upper end of the loop extends to a pair of horizontal bars 24 which are angularly disposed relative to each other as best shown in FIG. 5. These bars 24 are connected to the border wire 14 by clips 26.

The outermost vertical bars 20 extend downwardly from the bars 24 to the resiliently collapsible midportion of the spring. This midportion is formed of two separate collapsible columns, each of which has a torsion bar 28, an upper connector bar 30 and a lower connector bar 32. The lower connector bar extends to the base or lower portion of the spring which is mounted on the frame 4. This lower portion is formed of a single horizontal bar 34 which is freely rotatable but is held in position by staples which are driven into the end rail 16 of the frame 4. In practice, it has been found that the staple-driving force causes the bars 34 to indent the wood so as to form a bearing-like seat which supports the bars 34 for rotation.

As can be seen in FIG. 5, the torsion bars 28 are generally perpendicular to each other. The upper connector bars 30 are also generally perpendicular to each other, and they are substantially aligned with the outer edges of the sides and ends of the frame 4.

The vertical bars 20 of the corner spring 6 are desirable in the respect that they act as an inner form for the batting which serves as the filler material at the corners of a box spring. Thus, after extended use and during collapsing movement, the bars 20 prevent the filler material from collapsing inwardly. To some extent, the upper connector bars 30 also deter the inward movement of the filler material.

Figure 6:
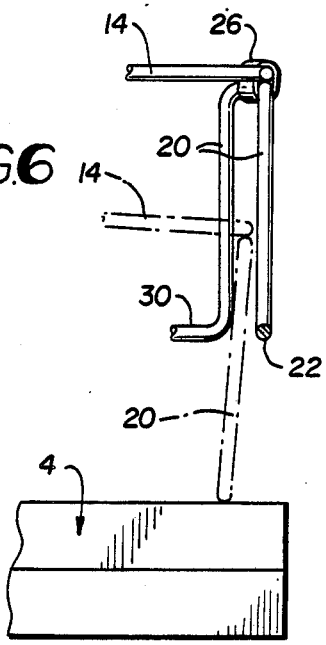
FIG. 6 is an elevational view of the corner spring portion illustrating the manner in which the uncompressible loop contacts the frame to limit the deflection of the spring.

Another function of the bars 20 is to limit the downward deflection of the corner spring 6. This will be understood by referring to FIG. 6 which shows, in dot-dash lines, the corner spring when it is deflected to the maximum extent possible. Here, it will be seen that the horizontal bar 22 is in the same horizontal plane as the bar 34, causing it to strike the frame 4 and prevent further resilient collapsing of the corner spring. In an unillustrated modified version, the horizontal bar 22 may be somewhat higher, in which event the deflection-limiting function would be served by the loop comprising the lower ends of the two outer vertical bars 20.

Experience has shown that, during the deflection of the corner spring 6, the two outer vertical bars 20 incline slightly from their vertical rest positions, thereby contributing somewhat to the resilience which is primarily provided by the torsion bar 28 and the connector bars 30 and 32.

The bedding unit is provided with many of the main support springs 8 which are distributed throughout the extent of the frame. As explained in my earlier patent applications referred to above, these springs 8 are preferably attached to the cross wires of the grid. Each spring has a Z-shaped lower portion which is connected by staples to a cross rail or end rail of the frame 4. The vertically collapsible midportion of this spring includes a lower connector bar 40, a torsion bar 42, and an upper connector bar 44 which extends to a transverse bar 46 in the upper portion of the spring.

The upper portion of spring 8 is substantially horizontal and it includes the transverse bars 46, a pair of hook means 48 which are arranged to extend over and hook under a wire 12 of the grid 2, and connecting sections which connect each of the hooks to one of the respective transverse bars 46. These connecting sections are preferably formed to include, sequentially from the transverse bar 46, an offset longitudinal bar 49 which is positionable in intersection underlying relation to a wire 10 of the grid, a transverse bar 50, and a longitudinally oriented center bar 51 which lies parallel to and bears laterally against the wire 12 which is engaged by the corresponding hook means 48.

Figure 3:
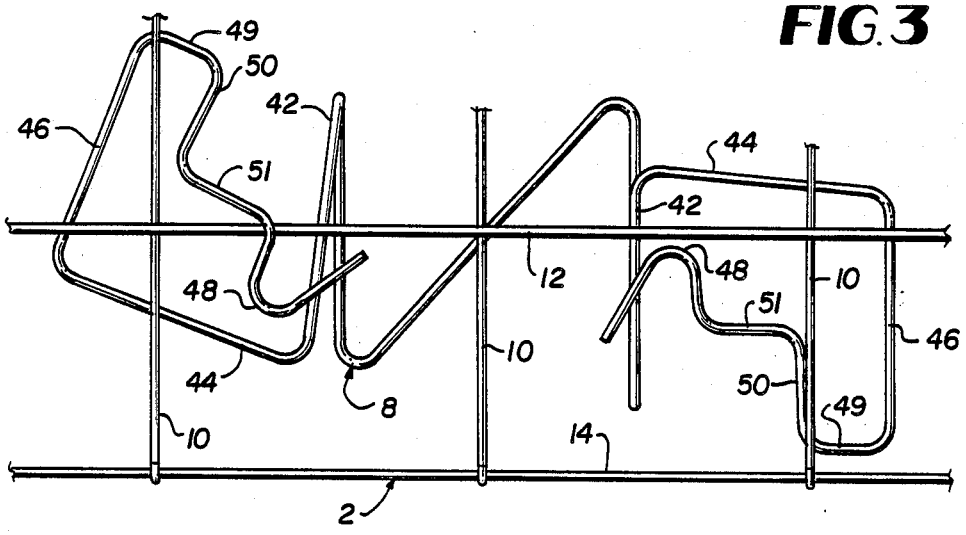
FIG. 3 is a plan view showing an early step in the procedure of attaching the hook-topped spring to a wire grid.
Figure 4:
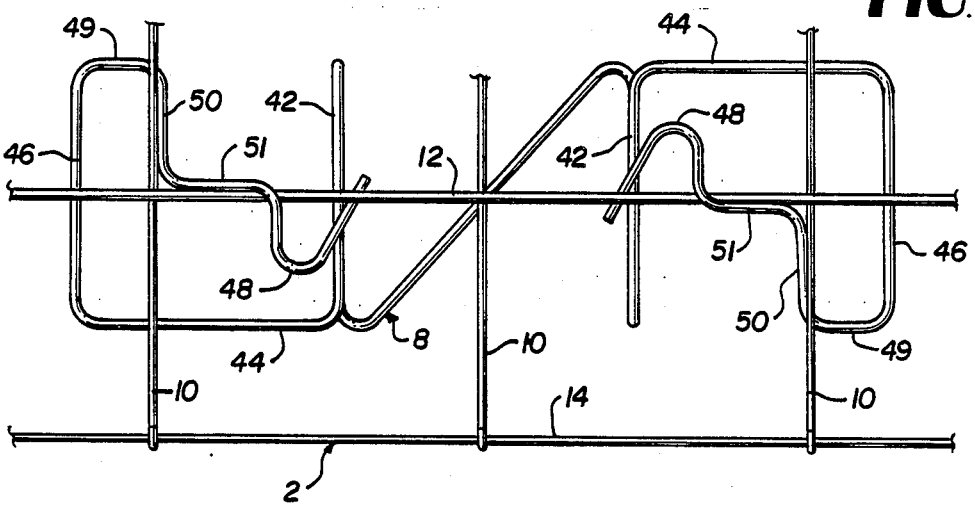
FIG. 4 illustrates the final attached position of the hook-topped spring to the wire grid.

The hook-topped springs 8 are conveniently attached to the wire grid using the procedure shown in FIG. 3 where it will be seen that the left hook 48 is initially passed over the wire 12. It is then rotated to a position where the center bar portion 51 and transverse portion 50 rest at an intersection of the wires 10 and 12, and the tip of the hook 48 goes beneath the wire 12. In this position, the right side hook 48 is then moved over the wire 12 until its tip goes beneath the wire, whereupon it is released so that it returns to the position shown in FIG. 4.

The spring 8 effectively supports the grid at the points where transverse bars 46 underlie the cross wire 12, and where the offset longitudinal bars 49 underlie the longwires 10. The bars 50 and 51 bear laterally against the longwire 10 and cross wire 12 to deter lateral movement of the spring. In the area of the hook 48, the hook bears downwardly on the cross wire 12 and, at its other point of contact, the hook exerts an angular force with vertical and horizontal components on the wire 12. To enhance the securement of the spring 8 to the grid, conventional clips such as those shown at 26 may be placed around the bars 51 and the adjacent section of the cross wire.

The downward deflection of the spring 8 is limited because, when the midportion of the spring resiliently collapses, the wire 12 of the grid 2 will contact the torsion bars 42.

The hook-topped springs facilitate the manufacture of box spring units by eliminating any need for spring-holding fixtures, by reducing the length of time required to attach the springs to the grid and, if desired, by eliminating the need for attachment clips. In the manufacturing process, the grid 2 is positioned upside down on a support, and the springs 8 are attached throughout the grid using the simple procedure illustrated in FIG. 3. Then, the grid/spring assembly is inverted, placed over a frame 4, and the lower portions of the springs are stapled to the frame. The latter step retains the lower portions of the springs at fixed orientations, and this is important because it prevents the springs from twisting laterally and becoming disengaged from the grid when they are collapsed.

From the foregoing, it will be appreciated that this invention presents certain advantages with respect to the prior art. Obviously, the invention may take many forms other than the exemplary embodiments disclosed. Therefore, it is emphasized that the invention is not limited only to the disclosed embodiments. It embraces modifications thereto and variations thereof which fall within the spirit of the following claims.

I claim:

1. A spring for supporting a wire grid on a frame of a bedding unit, said spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said upper portion being substantially horizontal and including a pair of transverse bars and a pair of hook means, each of said hook means being arranged to extend over and hook under a wire of the wire grid, said hook means being located and formed in opposite ends of the single resilient wire, said upper portion having a pair of connecting sections each of which connects a hook means to one end of a transverse bar.

2. A spring according to claim 1 wherein the transverse bars are torsion bars, said midportion including torsion bars and connector bars, said connector bars connecting the torsion bars of the midportion to the lower portion and to the transverse torsion bars of the upper portion.

3. A spring according to claim 2 wherein the midportion is vertically collapsible to a compressed position where the upper portion is in contact with the torsion bars of the midportion to limit the deflection of the spring.

4. A spring according to claim 1 wherein each connecting section is L-shaped and includes a longitudinal bar which is positionable in underlying relation to a wire of the grid.

5. A spring according to claim 1 wherein each of the connecting sections includes a longitudinally oriented center bar portion which lies parallel to and bears laterally against the wire engaged by the hook means.

6. A spring according to claim 1 in combination with a wire grid, a frame, and a plurality of said springs; said springs having their lower portions connected to the frame and their upper portions connected to the wire grid to form a bedding unit.

7. A bedding unit according to claim 6 which also includes a corner spring formed of a single resilient wire, said corner spring having a corner spring lower portion connected to the frame, a corner spring upper portion connected to the wire grid, and a resiliently collapsible corner spring midportion connecting the upper portion of the corner spring to the lower portion of the corner spring, said upper portion of the corner spring including a vertical loop which is substantially uncompressible in a vertical direction.

8. A bedding unit according to claim 6 wherein the frame includes a plurality of parallel crossrails which extend from side-to-side of the bedding unit, and the wire grid is formed of a plurality of longwires intersecting a plurality of crosswires, said crosswires of the wire grid lying in vertical alignment with the crossrails of the frame, at least some of said springs having their hook means connected to the crosswires.

9. A bedding unit according to claim 8 wherein the midportion of the spring includes torsion bars and connector bars, said connector bars connecting the torsion bars of the midportion to the lower portion and to the transverse bars of the upper portion, said grid being downwardly movable, when the midportion of the spring collapses, to a position where a wire of the grid contacts a torsion bar of the midportion of the spring to limit the deflection of the spring.

10. A corner spring for supporting a corner of a wire grid on a frame of a bedding unit, said corner spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said midportion including two vertically collapsible portions which are connected to opposite ends of said upper portion, each of said vertically collapsible portions having a torsion bar and connector bars, said upper portion including a vertical loop which is substantially uncompressible in a vertical direction.

11. A corner spring according to claim 10 wherein the upper portion has horizontal attachment bars which are connectible to the wire grid, said horizontal bars being angularly disposed relative to each other, said vertical loop having opposite ends which extend to said horizontal attachment bars.

12. A corner spring according to claim 10 wherein the midportion is collapsible to the extent that said vertical loop has a lower end which is downwardly movable to a position where it lies in the same horizontal plane as the lower portion, whereby the vertical loop contacts the frame to limit the deflection of the corner spring.

13. A corner spring according to claim 10 wherein the upper portion includes four vertical bars, two of which form opposite legs of said vertical loop.

14. A corner spring according to claim 10 wherein the torsion bars of the two vertically collapsible portions are perpendicular to each other.

15. A corner spring according to claim 10 wherein the lower portions comprise bars which are rotatable in response to vertical collapsing movement of the midportion of the spring.

16. A corner spring according to claim 10 in combination with a wire grid and a frame, said corner spring having its lower portion connected to the frame and its upper portion connected to the wire grid to form a bedding unit.

17. A spring for supporting a wire grid on a frame of a bedding unit, said spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said midportion including two vertically collapsible portions which are connected to opposite ends of said upper portion, each of said vertically collapsible portions having a torsion bar and connector bars, said lower portion comprising bars which are attached to each vertically collapsible portion and are rotatable and are free of torsion in response to vertical collapsing movement of the midportion of the spring.

18. A spring according to claim 17 in combination with a wire grid, a frame, and a plurality of said springs; said springs having their lower portions connected to the frame and their upper portions connected to the wire grid to form a bedding unit.

19. A combination according to claim 18 wherein the frame is wood and is indented to provide bearing-like seats which support said bars of the lower portion for rotation.

20. A corner spring for supporting a corner of a wire grid on a frame of a bedding unit, said corner spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said upper portion having horizontal attachment bars which are connectible to the wire grid, said horizontal bars being angularly disposed relative to each other, said vertical loop having opposite ends which extend to said horizontal attachment bars, said upper portion including a vertical loop which is substantially uncompressible in a vertical direction.

21. A corner spring for supporting a corner of a wire grid on a frame of a bedding unit, said corner spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said upper portion including a vertical loop which is substantially uncompressible in a vertical direction, said upper portion including four vertical bars, two of which form opposite legs of said vertical loop.

* * * * *